US006361602B1

(12) United States Patent
Hahn

(10) Patent No.: US 6,361,602 B1
(45) Date of Patent: Mar. 26, 2002

(54) APPARATUS FOR LUBRICATING THE EXTERIOR SURFACE OF AN ITEM AS A STRIP OF MATERIAL

(76) Inventor: Roger A. Hahn, 16576 W. 51st Pl., Golden, CO (US) 80403

( * ) Notice: Subject to any disclaimer, the term of this patent is extended or adjusted under 35 U.S.C. 154(b) by 0 days.

(21) Appl. No.: 09/460,272

(22) Filed: Dec. 13, 1999

(51) Int. Cl.[7] ..... B05C 1/06
(52) U.S. Cl. ..... 118/264; 118/266; 118/268
(58) Field of Search ..... 118/264, 266, 118/268; 427/429

(56) References Cited

U.S. PATENT DOCUMENTS 5,549,752 A 8/1996 Hahn et al.
5,985,028 A 11/1999 Cornell et al.
6,013,312 A 1/2000 Cornell et al.

OTHER PUBLICATIONS

"Lubriquip", Trabon, Bulletin 12825.

*Primary Examiner*—Laura Edwards
(74) *Attorney, Agent, or Firm*—Timothy J. Martin; Michael R. Henson; Mark H. Weygandt

(57) ABSTRACT

A coating station for an apparatus and method used to coat at least one side of a pontinuous strip of material includes a housing having a conduit that connects to a source of coating material, a fluid dispensing passageway and a wick that contacts the strip. The passageway has an intake port and a discharge port. A metering member is interposed in the passageway, and a drive rotates it about an axis between the intake and discharge ports. The metering member has a metering bore, and a reciprocating metering piston is disposed in the bore. The metering member may be a cylindrical shaft, and one or more metering bores extend diametrically through the shaft with each being provided with a piston to dispense predetermined amounts of coating material onto the strip.

25 Claims, 4 Drawing Sheets

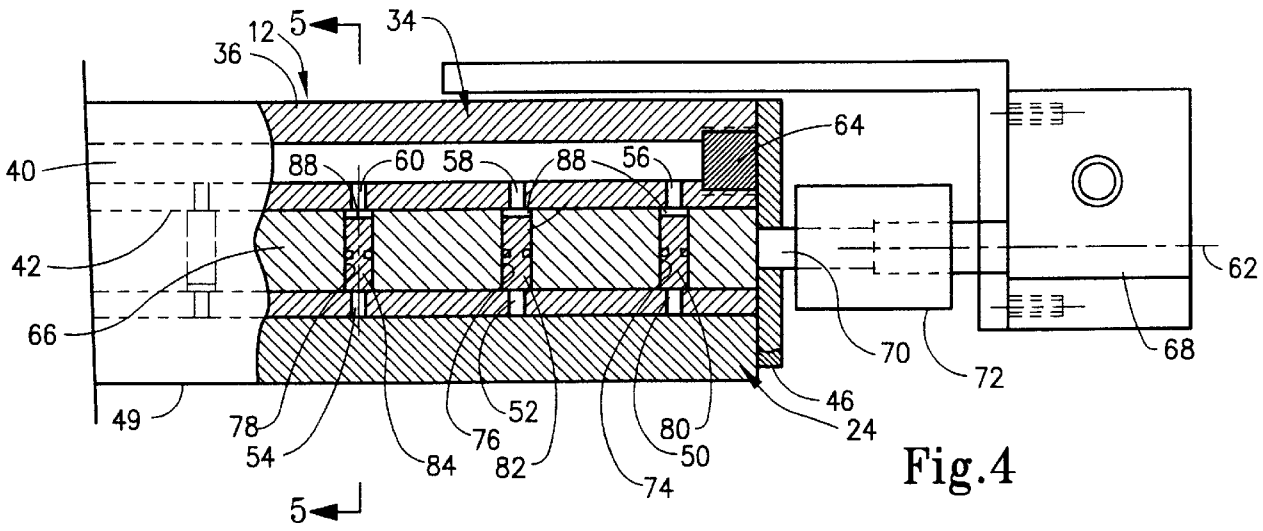
Fig.4
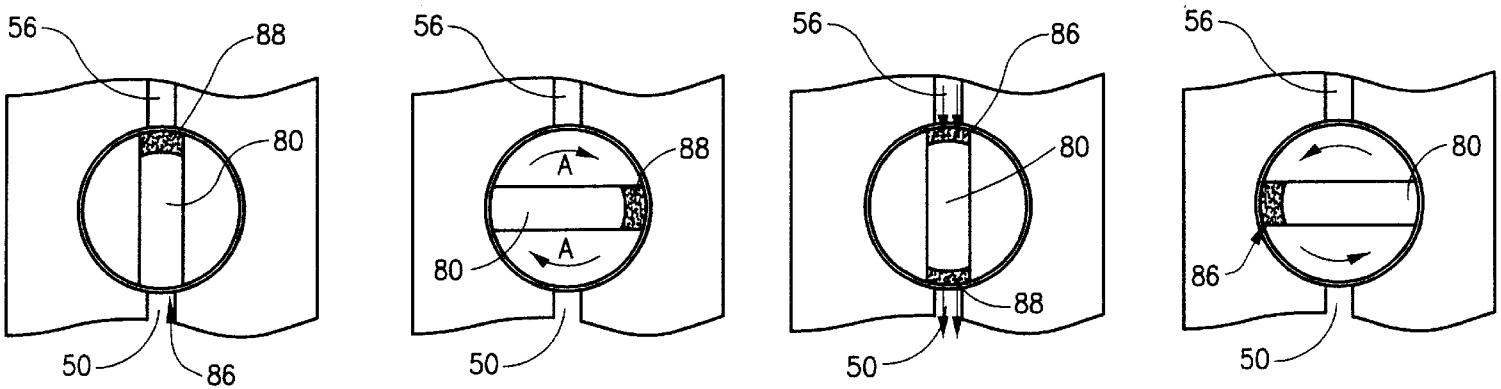
Fig.6d
Fig.6c
Fig.6b
Fig.6a

APPARATUS FOR LUBRICATING THE EXTERIOR SURFACE OF AN ITEM AS A STRIP OF MATERIAL

FIELD OF THE INVENTION

The present invention relates generally to apparatus useful in coating the surface of an item. More particularly, the present invention concerns apparatus for applying desired amounts of lubricant to each side of a continuous sheet of material used in the formation of a manufactured product. Specifically, the present invention relates to an improved coating station for coating the surface of a continuous sheet of aluminum used during the formation of aluminum cans.

BACKGROUND OF THE INVENTION

In the manufacture of aluminum cans, it is customary to feed a continuous strip or sheet of aluminum to a punch press that forms shallow cup-shaped blanks from the strip of material. The shallow cup-shaped blanks are then used in a body maker machine which pushes the blanks through can forming and ironing dies to elongate and shape the shallow cup-shaped blanks into aluminum can bodies. These operations require substantial contact between the various die apparatus and the aluminum sheet material. As a result of this contact and to reduce friction, it is necessary to apply a lubricating material to each side of the continuous sheet of aluminum prior to feeding the sheet material into the punch press and dies.

One conventional method of applying such lubricant layer to a continuous strip of aluminum is to pull the continuous strip of aluminum through a bath of lubricating material and then squeeze off any excess lubricant. As an alternative to this bath technique, a device and method for applying lubricant to a continuous sheet of aluminum material is disclosed in U.S. Pat. No. 5,549,752, the contents of which are specifically incorporated herein by reference. In this particular patent, a device is disclosed wherein coating stations are located on each side of a continuous sheet of material, and lubricant is dispersed onto the sides of the material in regulated amounts. Unfortunately, a complicated plunger mechanism in combination with the lubricant supply is required, and highly accurate control and adjustment of the amount of lubricant applied to the sheet of material remains elusive.

Consequently, there remains a need for an apparatus and technique wherein thin layers of lubricant may be applied to one or both sides of a continuous sheet of material in accurate amounts and wherein such amounts may be readily adjusted.

SUMMARY OF THE INVENTION

It is an object of the present invention to provide a new and useful coating device and a coating apparatus incorporating such device so as to apply a coating material to at least one side of a strip of material.

It is another object of the present invention to provide a new and useful coating station comprising a pair of coating devices so as to coat both sides of a strip of material.

Another object of the present invention is to provide an improved coating apparatus for deposing a layer of lubricant onto the surface of a continuous sheet of material wherein the amount of lubricant may be adjustable.

A further object of the present invention is to provide an apparatus for distributing careful metered amounts of lubricant onto a moving sheet of material or surface of an item.

Still a further object of the present invention is to provide a rotary metering assembly for supplying a coating material to a wick that is in contact with a sheet of material or surface of an item in order to apply the coating the material thereon.

According to the present invention, then, a coating device is provided that is operative to apply a coating of material from a source to the surface of an item. Broadly, the coating device of the present invention includes a housing that has a conduit adapted to connect to a source of coating material. A wick is supported by the housing and is adapted to contact the surface of the item. The housing has a fluid dispensing passageway in the form of intake port and fluid communication with the conduit and a discharge port in fluid communication with the wick. A metering member is interposed in the fluid dispensing passageway and is rotatably journaled in the housing about a longitudinal axis of rotation. The metering member has a metering bore formed therein, and a metering piston is disposed in the metering bore for reciprocation therein. A meter drive operates to rotate the metering member about the longitudinal axis. As the drive rotates the metering member, the metering bore is moved between the intake port wherein it receives coating material and a discharge port wherein the material is dispensed by the piston to the wick.

Preferably, the housing has a cylindrical chamber and the metering member is formed as a cylindrical shaft disposed in the chamber. The metering bore is then formed radially in the shaft, and preferably diametrically completely through the shaft. Here, also, the intake port and the discharge port are oriented in opposed, coaxial relationship to one another with the shaft being interposed between the intake port and the discharge port such that the metering bore rotates into and out of coaxial alignment with the intake port and the discharge port as the shaft is rotated.

Preferably, the housing has a plurality of longitudinally spaced fluid dispensing passageways each having an intake port and a discharge port that define a pair of dispensing ports. The metering member is then provided with a plurality of longitudinally spaced metering bores in one-to-one correspondence to the fluid dispensing passageways, and each of the metering bores is provided with a metering piston disposed therein. Adjacent ones of the fluid dispensing passageways are equidistantly spaced from one another. The conduit is formed, then, as a manifold supply having a plurality of outlets corresponding to each of the dispensing passageways.

The coating apparatus of the present invention includes at least one coating device as described above. A frame supports each of the coating devices. A meter drive is operative to rotate the metering member of each coating device about its longitudinal axis, and a strip drive is operative to advance the strips of material past the coating device. Preferably, two coating devices are provided in opposed relationship to one another thereby defining a coating station through which the strip of material is advanced. In such manner, both surfaces of the strips of material are simultaneously coated with the coating material.

It should thus be appreciated that the apparatus according to the present invention provides a plurality of metering elements disposed between the intake ports and the discharge ports to distribute a predetermined amount of coating material onto the wick. As noted above, these metering elements are preferably piston members disposed in longitudinally spaced transverse bores in a cylindrically rotating shaft. The volume of fluid or coating material dispensed in the coating device of the present invention may be varied either by changing the size of the bores in the metering shaft, by changing the size of the pistons, or changing the speed of rotation of the dispensing shaft.

These and other objects of the present invention will become more readily appreciated and understood from a consideration of the following detailed description of the exemplary embodiment of the present invention when taken together with the accompanying drawings, in which:

BRIEF DESCRIPTION OF THE DRAWINGS

FIG. 4 is a view substantially similar to that of FIG. 3 but illustrating the metering members thereof in position after receiving new discrete amounts of lubricant and having discharged lubricant to the wick portion thereof;

FIGS. 6(*a*)–6(*d*) are similar to FIG. 5 and illustrate the cycling of the metering device of the present invention.

DETAILED DESCRIPTION OF THE EXEMPLARY EMBODIMENTS

The present invention is directed to a coating apparatus that is operative to apply a coating material, preferably in fluid form, onto the surface of an item. While it is contemplated that this invention can be used in other applications, the invention is particularly useful in coating one or both sides of a continuous strip of material during a fabrication process, such as a can-forming process. Thus, the invention is described in the context of coating a continuous sheet of material, but it should be understood that the principles and structure may be modified by the skilled artisan for use in coating other items.

Broadly, the exemplary embodiment of the present invention is directed to a coating apparatus that includes at least one coating device, a frame that supports the coating device (s), a drive that operates the coating device and a strip drive that advances a strip of material through the apparatus past the coating device(s). Preferably, a pair of opposed coating devices are provided to define a coating station. The coating devices each include a housing, a wick that applies the coating material to the surface to be coated, a rotatable metering member that has a metering bore extending therein, a metering piston disposed in the bore, preferably for free-sliding movement, and a meter drive that rotates the metering member.

Figure 1:
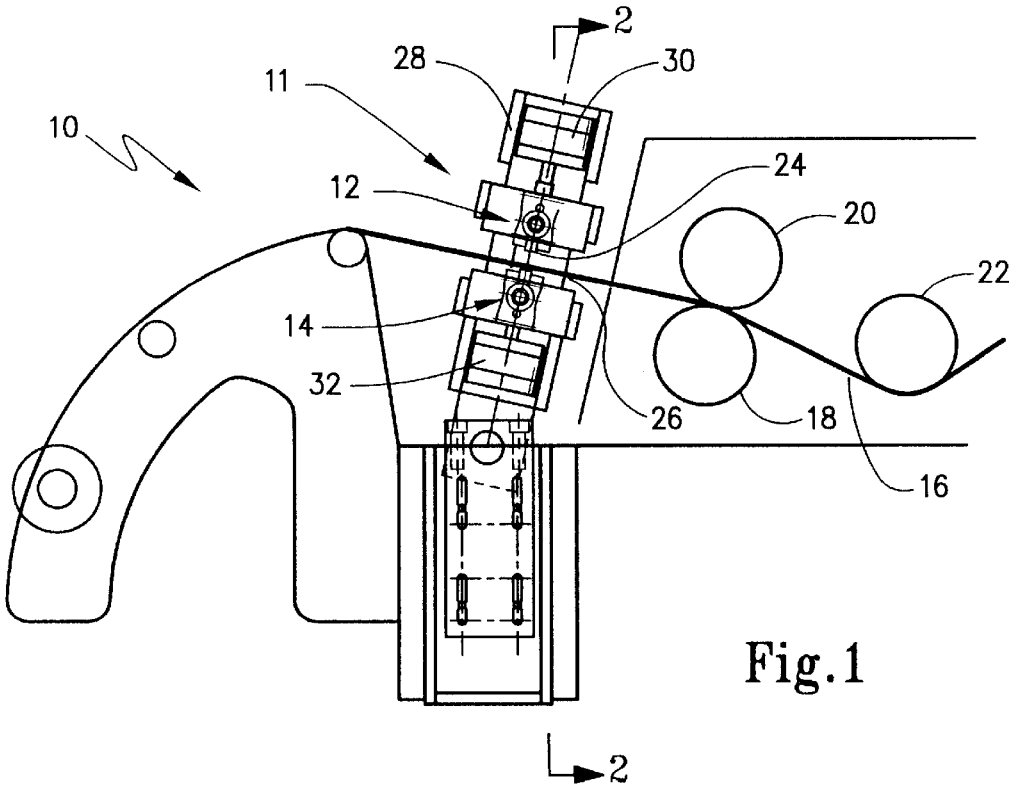
FIG. 1 is a side elevation view of an exemplary embodiment of a coating apparatus according to the present invention in position for coating both sides of a continuous sheet of material.
Figure 2:
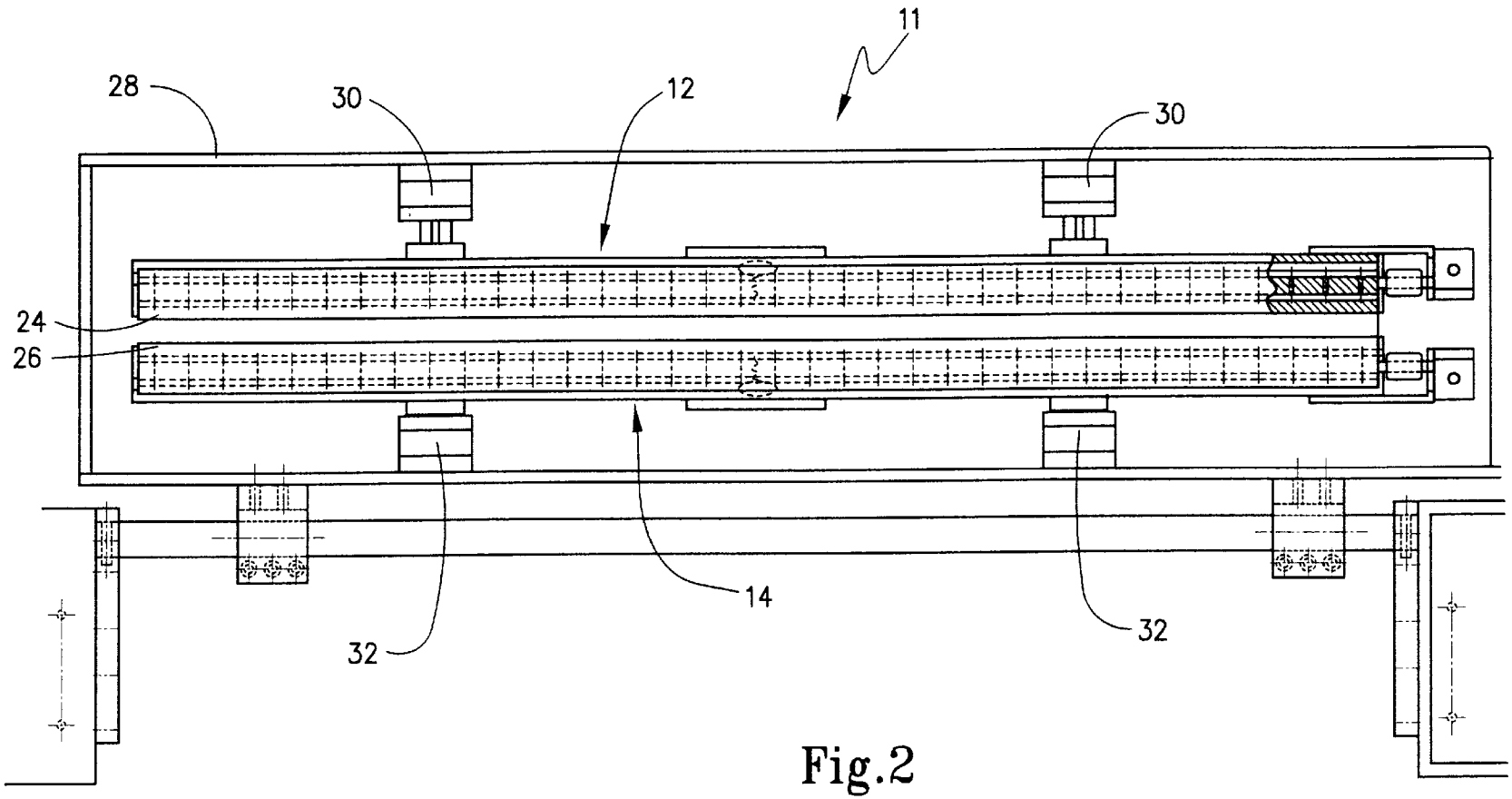
FIG. 2 is a cross-sectional view taken substantially along line 2—2 of FIG. 1.

Referring first then to FIGS. 1 and 2, a coating apparatus 10 according to the exemplary embodiment of the present invention is illustrated utilizing the coating station 11 of the present invention. It should be understood that in the preferred embodiment of the present invention, coating station 11 includes a pair of oppositely oriented coating devices 12,14 that are provided so that both sides of a continuous sheet of material 16 may be lubricated simultaneously. The coating devices 12,14 are preferably substantially identical to each other except for the fact that they are oriented in opposed relation to one another to coat the opposite side of the sheet of material 16. Therefore, only one such coating device 12 will be discussed in detail herein with the understanding that the coating device 14 is identical in structure and operation to the coating device 12.

A continuous sheet or strip of material 16, such as an aluminum sheet, is moved through the coating apparatus 10 past a coating station 11, specifically between the coating devices 12,14 utilizing any desired and known manner. In the illustrated embodiment, a pair of spaced drive rollers 18, 20 and an idler roller 22 function in a conventional manner to move the sheet 16 between wicks 24, 26 of the coating devices 12,14, respectively. The coating devices 12,14 are mounted to a frame 28. Drive members 30, 32 are provided to move the coating devices 12,14 and their respective wicks 24, 26 into and out of engagement with the sheet 16 as it is desired to activate or deactivate, respectively, the coating station 10. Drive members 30,32 are preferably pneumatic piston drives, but can be other mechanisms as is known in the art. In this manner, then, lubricant from the devices 12,14 may be distributed as desired by wicks 24, 26 over both surfaces of the continuous sheet 16. Once the sheet of material 16 is so coated, it is moved into a formation punch press, such as a can blank former, in accordance with known techniques and processes.

Figure 5:
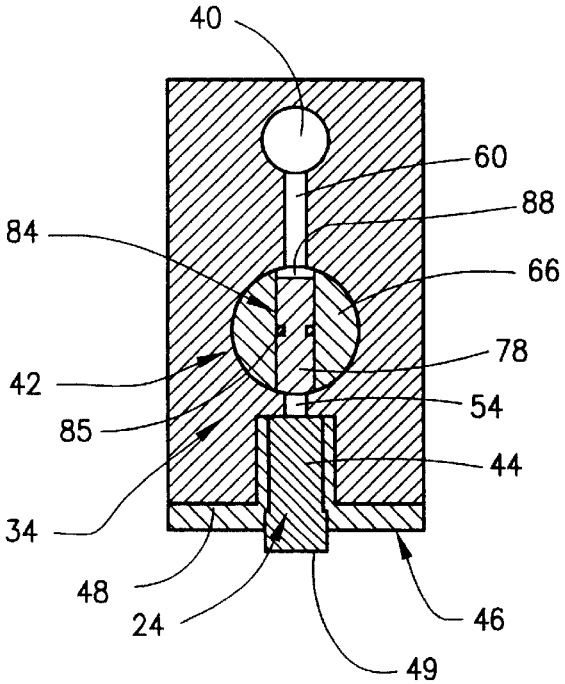
FIG. 5 is a cross-sectional view taken substantially along line 5—5 of FIG. 4.
Figure 3:
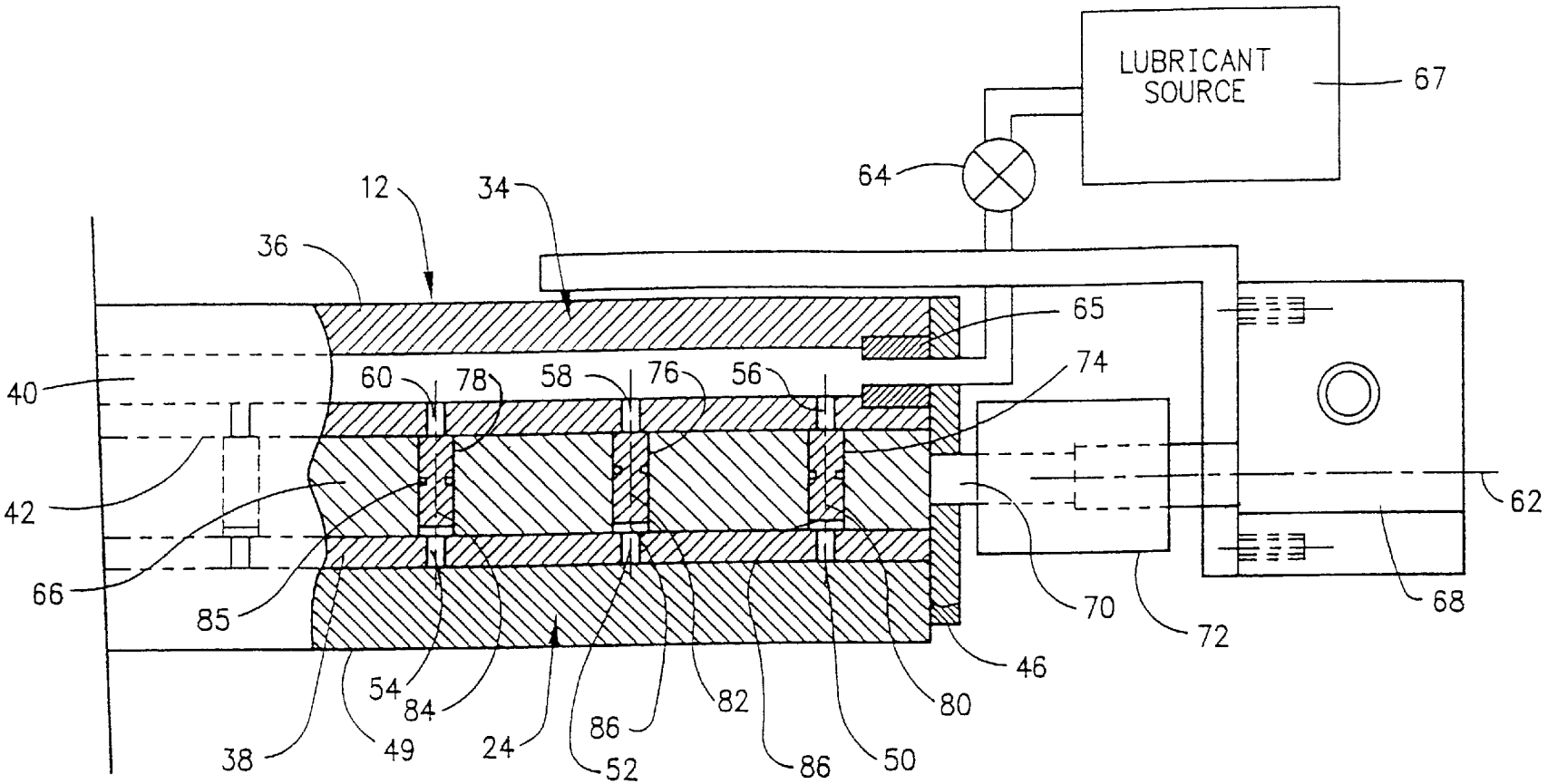
FIG. 3 is a front view in elevation, partially broken-away, illustrating the exemplary embodiment of the end portion of the coating station of the present invention with the metering members thereof in position for receiving new discrete amounts of lubricant and in position to discharge lubricant into the wick portion thereof.

Referring now to FIGS. 3–5, the specific coating device 12 as constructed in accordance with the present invention is disclosed and illustrated with greater particularity. In preferred form, the coating device 12 includes a housing 34 having an upper portion 36 and a lower portion 38. The previously mentioned wick 24 is secured along the lower portion 38 in a manner described in greater detail below. A conduit 40 is formed in the upper portion 36 and extends longitudinally along substantially the entire length of the housing 34. A cylindrical chamber 42 also extends longitudinally along the housing 34 substantially parallel to the conduit 40. In preferred formed, the cylindrical chamber 42 is positioned between the conduit 40 and the wick 24.

A longitudinal recess 44 is preferably formed in the bottom portion 38 of the housing 34 and is sized and shaped to receive the wick 24 therein. In preferred form, the wick 24 is maintained in the recess 44 by a retainer plate 46 which is removably mounted to the bottom surface 48 of the bottom portion 38. The wick 24 projects outwardly from the plate 46 so that it provides a surface 49 that can contact a surface of the continuous strip of material 16. The wick 24 preferably is formed from a soft absorbent material such as an open-celled polyurethane foam, felt or other materials having similar characteristics, and includes an outermost surface 49 which is designed to engage the surface of the sheet 16 and disburse lubricant thereon.

A plurality of spaced apart discharge ports 50, 52 and 54 are preferably formed in the lower housing portion 38 and are in fluid communication with the longitudinally extending chamber 42 and the wick 24. In this manner, lubricant can be dispersed into the wick 24 through the discharge ports 50, 52 and 54 for absorption and migration to the surface 49. Ports 50, 52 and 54 are oriented radially of cylindrical chamber 42 and are perpendicularly transverse to axis "L"thereof. However, these ports could be oblique to passageway, if desired. Thus, for purposes of this application, the term "transverse" is intended to mean any orientation that is perpendicular to or oblique to axis "L" and whether intersecting axis "L" or not. Likewise, a plurality of intake ports 56, 58 and 60 are provides in housing 34 along the upper housing portion 36. These ports 56, 58 and 60 provide fluid communication between the lubricant supply passageway 40 and the distribution passageway 42. Ports 56, 58, and 60 are transverse to passageway 42 and are preferably radially oriented thereto. It should be understood that any number of ports may be provided to accomplish even distribution of the coating material to the wick. These ports may be spaced equidistantly apart from one another. Alternatively, the spacing can be customized for a particular application.

In the preferred form of the present invention, ports 50/56, 52/58 and 54/60 are respectively aligned axially with each other to define dispensing pairs that form passageways between conduit 40 and wick 24. In this manner, coating fluid may pass from outlets in the conduit 40 through the ports 56, 58 and 60 into the chamber 42 and then through the ports 50, 52 and 54 and onto the wick 24. It should be understood that the total number of dispensing pairs can be selected as desired for a particular use. The lubricant or other coating material is preferably supplied from a lubricant source 67 under elevated pressure to the conduit 40 through a one-way valve 64 and fitting 65. The valve 64 is connected by standard tubing members to the supply source 67 as is known in the art.

Since it is important to control the amount of lubricant applied to the surfaces of the continuous sheet of material 16, a lubricant metering assembly is provided in the device 12, Preferably, the metering assembly is interposed in each fluid dispensing passageway. This metering assembly selectively meters the amount of lubricant coating material being distributed into and absorbed by the wick 24 and controls the evenness of the distribution. This in turn controls the amount and uniformity of lubricant subsequently applied to the continuous sheet of material 16 at the surface 49 of the wick 24.

In preferred form, the lubricant metering assembly includes a metering member in the form of a rotatable cylindrical shaft 66 that is disposed in sealing relation within the cylindrical chamber 42. A meter drive 68 is attached to the shaft 66 by a shank member 70 and a coupling 72 for rotating shaft 66. Preferably, meter drive 68 is a pneumatic rotating actuator that rotatably reciprocates the shaft 180 degrees in opposite angular directions during a drive cycle. However, meter drive 68 could be an electric motor, for example, that rotates shaft 66 in a continuous angular direction. The shaft 66 may be rotated at any desired speed within the chamber 42. A plurality of metering bores 74, 76 and 78 are formed transversely through the shaft 66. The bores 74, 76 and 78 are spaced apart from one other the same distance as the spacing between the bore pairs 50/56, 52/58 and 54/60. Accordingly, when shaft 66 is at two rotational positions 180° apart, these port pairs and the respective bores 74, 76 and 78 are axially aligned.

In preferred form, a plurality of metering elements are positioned in the chamber 42 and are controlled by the rotation of the shaft 66. The metering elements are arranged to distribute discrete amounts of lubricant to the ports 50, 52, 54 and into the wick 24. In the preferred form of the invention, metering members are in the form of a reciprocating piston 80, 82 and 84, respectively. Each piston 80, 82 and 84 preferably includes a sealing member 85, such as an O-ring, disposed about the center portion thereof to prevent liquid from passing along the outside surface of the pistons 80, 82 and 84. The pistons 80, 82 and 84 are sized and shaped for sealing engagement against the inner surfaces of their respective bores 74, 76 and 78 but are sized shorter in length than their respective bores. In this manner, spaces 86 and 88 alternatingly formed between the inner end of each piston 80, 82 and 84 and one end of its respective bore 74, 76 and 78 at the respective laterally oriented mouths thereof. The volume of the spaces 86 and 88 determine the discrete amount of lubricant metered into the wick 24 with each rotation of the shaft 66. Thus, the size of the pistons 80, 82, 84 will determine the volume of the discrete amount of lubricant disbursed with each 180° rotation of the shaft 66.

As can be seen in FIG. 3, the spaces 86 are disposed proximate the ports 50, 52 and 54, while the opposite ends of the pistons 80, 82 and 84 abut the ends of their respective bores 74, 76 and 78 proximate the ports 56, 58 and 60. When the pistons are so aligned as illustrating FIG. 3, liquid pressure from the lubricant in the supply passageway 40 presses and moves the pistons 80, 82 and 84 in the direction of the ports 50, 52 and 54 until the spaces 86 are eliminated. When this occurs, as illustrated in FIG. 4, new spaces 88 are formed at the opposite ends of the pistons 80, 82 and 84 which become filled with lubricant from the supply passageway 40 by way of the ports 56, 58 and 60 as the spaces 88 are created.

As the shaft 66 continues to rotate (arrow "A" in FIG. 6(*b*)), bores 74, 76 and 78 are blocked by the inner surface of the distribution passageway 42 until the bores 74, 76 and 78 are again aligned with the ports 56, 58 and 60 and the ports 50, 52 and 54, 180° out of rotation from the prior shaft position. In this position, the spaces 88 are now in the position of the spaces 86 in FIG. 3, i.e. they are adjacent the ports 50, 52 and 54. The liquid pressure from the supply passageway 40 and the ports 56, 58 and 60 again move the pistons 80, 82 and 84 along their respective bores 74, 76 and 78 to inject the lubricant material from the inverted spaces 88 into the wick 24 while creating inverted spaces 86 filled with lubricant. The angular direction of rotation in reversed (arrow "B" in FIG. 6(*d*)). This cycle repeats itself as is illustrated in FIGS. 6(*a*) through 6(*d*).

The amount of liquid lubricant metered into the wick 24 and thus distributed onto the surface of the continuous sheet 16 may be varied by varying the speed of reciprocation of the shaft 66 within the distribution passageway 42. The faster the reciprocation speed of the shaft 66, the greater the amount of lubricant dispersed onto the sheet 16. Likewise, the lubricant amounts may be adjusted by changing the size of bores 74, 76 and 78 and the respective pistons 80, 82 and 84. By changing the length of the pistons, the volume of the spaces 86, 88 may also be altered. Thus, the shorter the pistons 80, 82 and 84, the greater the volume of the spaces 86 and 88 and the greater the amount of lubricant injected into the wick 24 with each stroke of the pistons. Consequently, if it is desired to quickly increase the amount of lubricant metered onto the sheet 16, it is only necessary to increase the angular rotation speed of the shaft 66. If a more permanent increase is desired, the pistons may be changed out to shorter versions to increase the lubricant volume with each rotation of the shaft 66. In either event, the amount of lubricant metered onto the surface of the sheet 16 may be very carefully controlled utilizing the construction of the present invention. Moreover, it should also be noted that the consistent spacing of the aligned ports 50, 52 and 54, the ports 56, 58 and 60 and the bores 74, 76 and 78 permit even lubricant distribution into the wick 24 and over the surface of the sheet 16.

As can be seen from the above, the present invention provides an apparatus that enables carefully controlled amounts of liquid material to be dispersed over the surface of a continuous sheet of material. The amount of lubricant being dispersed onto the sheet 16 may be quickly adjusted without stopping the lubricating and can making process. Moreover, these lubricant amounts are also evenly dispersed onto the surface of the continuous sheet on a consistent basis. This is accomplished by the internal arrangement of the device of the invention. Consequently, the process of making aluminum can blanks and subsequently forming the cans is more readily controlled by the coating device of the present invention due to the careful lubricating capability of the invention.

Accordingly, the present invention has been described with some degree of particularity directed to the exemplary embodiment(s) of the present invention. It should be appreciated, though, that the present invention is defined by the following claims construed in light of the prior art so that modifications or changes may be made to the exemplary embodiment of the present invention without departing from the inventive concepts contained herein.

I claim:

1. A coating device operative to apply a coating material from a source to a surface of an item, comprising:

(a) a housing having a conduit adapted to connect to a source of coating material;

(b) a wick supported by said housing and adapted to contact the surface of the item, said housing having a fluid dispensing passageway with an intake port in fluid communication with the conduit and a discharge port in fluid communication with said wick;

(c) a metering member interposed in the fluid dispensing passageway and rotatably journaled in said housing about a longitudinal axis of rotation, said metering member having a metering bore formed therein and including a metering piston disposed in the metering bore for reciprocation therein; and (d) a meter drive operative to rotate said metering member about the longitudinal axis, said drive operative to rotate said metering member to move the metering bore between the intake port and the discharge port.

2. A coating device according to claim 1 wherein said housing has a cylindrical chamber and wherein said metering member is formed as a cylindrical shaft disposed in the chamber.

3. A coating device according to claim 2 wherein the metering bore is formed radially in said shaft.

4. A coating device according to claim 3 wherein the metering bore is formed diametrically completely through said shaft.

5. A coating device according to claim 4 wherein the intake port and the discharge port are oriented in opposed co-axial relationship to one another, said shaft being interposed between the intake port and the discharge port such that the metering bore rotates into and out of co-axial alignment with the intake port and the discharge port as said shaft is rotated.

6. A coating device according to claim 1 wherein said housing has a plurality of longitudinally spaced fluid dispensing passageways each with an intake port and a discharge port defining a pair of dispensing ports, said metering member including a plurality of longitudinally spaced metering bores in one-to-one correspondence to the fluid dispensing passageways, each of the metering bores provided with a metering piston disposed therein.

7. A coating device according to claim 5 wherein adjacent ones of the fluid dispensing passageways are equidistantly spaced from one another.

8. A coating device according to claim 7 wherein said housing has a cylindrical chamber and wherein said metering member is formed as a cylindrical shaft disposed in the chamber, each metering bore is formed diametrically completely through said shaft and wherein the intake port and the discharge port of each respective pair of dispensing ports are oriented in opposed co-axial relationship to one another, said shaft being interposed between the intake port and the discharge port such that a metering bore rotates into and out of co-axial alignment with a respective pair of dispensing ports as said shaft is rotated.

9. A coating device according to claim 6 wherein said conduit is formed as a manifold supply having a plurality of outlets corresponding to each of the dispensing passageways.

10. A coating apparatus operative to apply a coating material to at least one side of a strip of material, comprising:

(a) at least one coating device comprising:

(i) a housing having a conduit adapted to connect to a source of coating material;

(ii) a wick supported by said housing and adapted to contact the surface of the item, said housing having a fluid dispensing passageway with an intake port in fluid communication with the conduit and a discharge port in fluid communication with said wick;

(iii) a metering member interposed in the fluid dispensing passageway and rotatably journaled in said housing about a longitudinal axis of rotation, said metering member having a metering bore formed therein; and (iv) a metering piston disposed in the metering bore for reciprocation therein;

(b) a meter drive operative to rotate said metering member about the longitudinal axis, said drive operative to rotate said metering member to move the metering bore between the intake port and the discharge;

(c) a frame supporting said at least one coating device; and (d) a strip drive operative to advance said strip of material past said coating device.

11. A coating apparatus according to claim 10 including a pair of coating devices oriented in opposed relationship to one another to define a coating station, said strip drive operative to advance said strip of material between said coating devices.

12. A coating apparatus according to claim 11 wherein each said housing has a cylindrical chamber and wherein each said metering member is formed as a cylindrical shaft disposed in the chamber.

13. A coating apparatus according to claim 12 wherein each said housing has a plurality of longitudinally spaced fluid dispensing passageways each with an intake port and a discharge port defining a pair of dispensing ports, each said metering member including a plurality of longitudinally spaced metering bores in one-to-one correspondence to the fluid dispensing passageways, each of the metering bores provided with a metering piston disposed therein.

14. A coating apparatus according to claim 13 wherein each metering bore is formed diametrically completely through said shaft.

15. A coating apparatus according to claim 13 wherein adjacent ones of the fluid dispensing passageways are equidistantly spaced from one another.

16. A coating apparatus according to claim 13 wherein the intake port and the discharge port of each respective pair of dispensing ports are oriented in opposed co-axial relationship to one another, said shaft being interposed between the intake port and the discharge port such that a metering bore rotates into and out of co-axial alignment with a respective pair of dispensing ports as said rod is rotated.

17. A coating apparatus according to claim 13 wherein said conduit is formed as a manifold supply having a plurality of outlets corresponding to each of supply passageways.

18. An apparatus for applying a coating material to at least one side of a continuous strip of material, said apparatus comprising:

(a) a coating station including a housing;

(b) a drive mechanism for moving said continuous strip of material through said coating station;

(c) a wick supported on said housing and arranged for contact with one side of said continuous strip of material;

(d) a conduit disposed in said housing in fluid communication with a source of coating material;

(e) a plurality of fluid dispensing passageways disposed in said housing wherein each of the fluid dispensing passageways has (i) an intake port in fluid communication with said conduit, and (ii) a discharge port in fluid communication with said wick; and (f) a metering element disposed between the intake port and the discharge port of each of said fluid dispensing passageways to distribute predetermined amounts of said coating material from said conduit onto said wick, said metering element being in one-to-one correspondence with each of said fluid dispensing passageways.

19. The apparatus as claimed in claim 18, wherein said housing includes a cylindrical chamber expending longitudinally therein and interposed between the intake ports and the discharge ports, and including a rotatable shaft disposed in said chamber, said shaft supporting said metering elements to distribute said predetermined amounts of said coating material into, said wick at set rotational positions of said shaft.

20. The apparatus as claimed in claim 19, wherein said metering elements are disposed along the length of said shaft.

21. The apparatus as claimed in claim 20, wherein said shaft includes a plurality of longitudinally spaced transverse bores disposed therethrough, and wherein each said metering element comprises a piston adapted for reciprocal movement within a respective bore between opposite ends thereof to create a space between an interior end of said piston and an open end of said bore, said space representing said predetermined amount of fluid for movement from said conduit to said wick.

22. The apparatus as claimed in claim 21, wherein said intake ports, said discharge ports and said transverse bores are spaced and positioned in said housing to selectively permit fluid to flow from said conduit to said wick in each of two rotational positions of said shaft when each pair of dispensing ports and a respective bore are substantially coaxial, said bores being misaligned with said dispensing ports in other rotational positions of said shaft to prevent flow of fluid therebetween.

23. The apparatus as claimed in claim 22, wherein each said piston is adapted to simultaneously discharge a predetermined amount of fluid defined by the volume of said space into said wick through one said discharge port while filling said bore with a predetermined amount of fluid at the opposite end thereof by fluid pressure from said conduit in each of said two rotational positions.

24. The apparatus as claimed in claim 19, wherein the speed of rotation of said shaft is variable to control the amount of coating material dispersed into said wick and onto said strip of material.

25. The apparatus as claimed in claim 18, wherein said apparatus includes a pair of said applicator housings disposed on opposite sides of said continuous strip of material to simultaneously coat both sides of said strip of material.

* * * * *